United States Patent [19]

Roberts et al.

[11] Patent Number: 4,819,665

[45] Date of Patent: Apr. 11, 1989

[54] AEROSOL DELIVERY ARTICLE

[75] Inventors: Donald L. Roberts; Carl C. Morrison; Johnny L. Brooks; Evon L. Crooks; Bradley J. Ingebrethsen, all of Winston-Salem, N.C.

[73] Assignee: R. J. Reynolds Tobacco Company, Winston-Salem, N.C.

[21] Appl. No.: 6,191

[22] Filed: Jan. 23, 1987

[51] Int. Cl.[4] ..... A24F 1/00; A24D 1/02

[52] U.S. Cl. ..... 131/195; 131/194; 131/336; 131/359

[58] Field of Search ..... 131/194, 195, 336, 360, 131/364, 359, 369, 339

[56] References Cited

U.S. PATENT DOCUMENTS

| | | | |
|---|---|---|---|
| 1,529,181 | 3/1925 | Holmes . | |
| 1,862,679 | 6/1932 | Holsman . | |
| 2,104,266 | 1/1938 | McCormick . | |
| 2,754,828 | 7/1956 | Swain . | |
| 2,907,686 | 10/1959 | Siegel . | |
| 3,046,994 | 7/1962 | Schur . | |
| 3,258,015 | 6/1966 | Ellis et al. . | |
| 3,356,094 | 12/1967 | Ellis et al. . | |
| 3,410,273 | 11/1968 | Bolles . | |
| 3,469,584 | 9/1969 | Doppelt . | |
| 3,496,945 | 2/1970 | Tomkin . | |
| 3,515,146 | 6/1967 | Nealis . | |
| 3,516,417 | 6/1970 | Moses . | |
| 3,664,350 | 5/1972 | Wall . | |
| 3,738,374 | 6/1973 | Bennett . | |
| 3,774,622 | 11/1973 | Steigerwald . | |
| 3,828,799 | 8/1974 | Beam . | |
| 3,834,399 | 9/1974 | Beam . | |
| 3,847,161 | 11/1974 | Morgenstern . | |
| 3,943,941 | 3/1976 | Boyd et al. . | |
| 4,027,679 | 6/1977 | Kaswan | 131/339 |
| 4,044,777 | 8/1977 | Boyd et al. . | |
| 4,079,742 | 3/1978 | Rainer et al. . | |
| 4,219,032 | 8/1980 | Tabatznik et al. . | |
| 4,273,141 | 6/1981 | Van Tilburg . | |
| 4,284,089 | 8/1981 | Ray . | |
| 4,286,604 | 9/1981 | Ehretsmann et al. . | |
| 4,326,544 | 4/1982 | Hardwick et al. . | |
| 4,340,072 | 7/1982 | Bolt et al. . | |
| 4,355,995 | 10/1982 | Berger . | |
| 4,391,285 | 7/1983 | Burnett et al. . | |
| 4,474,191 | 10/1984 | Steiner . | |
| 4,481,960 | 11/1984 | Brooks . | |
| 4,570,649 | 2/1986 | Nichols et al. . | |
| 4,624,268 | 11/1986 | Baker et al. . | |

FOREIGN PATENT DOCUMENTS

| | | | |
|---|---|---|---|
| 174645 | 3/1986 | European Pat. Off. . | |
| 2057422 | 4/1971 | France . | |
| 2057421 | 5/1971 | France . | |
| 35-9894 | 5/1960 | Japan . | |
| 1185887 | 3/1970 | United Kingdom | 131/359 |
| 1431045 | 4/1972 | United Kingdom . | |

OTHER PUBLICATIONS

*Influence of Filter Additives on Smoke Composition* Reynolds, Rec. Adv. Tob. Sci., pp. 47–67, 1978.

*Direct Vapor Chromatographic Determination of Menthol, Propylene Glycol, Nicotine and Triacetin In Cigarette Smoke* Tob. Sci. XI, pp. 49–51, 1967.

*Factors that Affect Elution of Plasticizer from Cigarette Filters* Keifer et al., Eastman Kodak Pub. No. FTR-65, 1980.

*Beaver County Times* (Jul. 1967).

Mr. Herbert A. Gilbert's Article Submitted to the Senate Committee on Commerce, Sep. 1967.

*Guinness Book of World Records* pp. 242–243, 1985.

*Primary Examiner*—V. Millin

[57] ABSTRACT

An aerosol delivery article is capable of producing substantial quantities of smoke, both initially and over the useful lifetime of the product, without significant thermal degradation of the aerosol former and without the presence of substantial pyrolysis or incomplete combustion products or sidestream smoke. The article also delivers very low levels of carbon monoxide. The article is able of providing the user with the sensations and benefits of cigarette smoking without burning tobacco. The article includes a carbonaceous fuel element, an aerosol forming substance within a heat conductive container, an outer member surrounding the heat conductive container, and a mouthend piece. Upon draw on the mouthend piece air enters the peripheral region of the outer member and enters the heat conductive container. As the heat conductive container is in a heat exchange relationship with the fuel element, aerosol is thereby formed within the container and passed to the mouth of the user.

44 Claims, 5 Drawing Sheets

AEROSOL DELIVERY ARTICLE

BACKGROUND OF THE INVENTION

The present invention relates to cigarette-type smoking articles that produce an aerosol resembling tobacco smoke, but which contain no more than a minimal amount of incomplete combustion or pyrolysis products.

Many smoking articles have been proposed through the years, especially over the last 20 to 30 years.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 none of the extensive efforts, it is believed that proposed products has been found to be satisfactory as a tobacco substitute.

Many smoking articles have been based on the generation of an aerosol or a vapor. Some of these products purportedly produce an aerosol or a vapor without heat. See, for example, U.S. Pat. No. 4,284,089 to Ray. However, the aerosols or vapors from these articles fail to adequately simulate tobacco smoke.

Some proposed aerosol generating smoking articles are believed to have used a heat or fuel source in order to produce an aerosol. One of the earliest of these proposed articles is described by Siegel in U.S. Pat. No. 2,907,686. The Siegel reference proposed a cigarette substitute which includes an absorbent carbon fuel, preferably a 2.5 inch (63.5 mm) stick of charcoal, which is burnable to produce hot gases, and a flavoring agent carried by the fuel, which is adapted to be distilled off incident to the production of the hot gases. Siegel also proposed that a separate carrier, such as clay, may be used for the flavoring agent, and that a smoke-forming agent, such as glycerol, may be admixed with the flavoring agent. Siegel's proposed cigarette substitute may be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another smoking article is described by Ellis et al in U.S. Pat. No. 3,258,015. Ellis et al proposed a smoking article which has an outer cylinder of fuel having good smoldering characteristics, preferably fine cut tobacco or reconstituted tobacco, surrounding a metal tube containing tobacco, reconstituted tobacco, or other source of nicotine and water vapor. It is believed that upon smoking, the burning fuel heats the nicotine source material to cause the release of nicotine vapor and potentially aerosol generating material, including water vapor. It is proposed that the vaporized materials are mixed with heated air which enters the open end of the tube. A substantial disadvantage of this article includes the ultimate protrusion of the metal tube as the tobacco fuel is consumed. Other apparent disadvantages of this proposed smoking article included the presence of substantial tobacco pyrolysis products, the substantial tobacco sidestream smoke and ash, and the possible pyrolysis of the nicotine source material in the metal tube.

In U.S. Pat. No. 3,356,094, Ellis et al disclose a modification of their original design to eliminate the protruding metal tube upon use. The allegedly improved design employed a tube made out of a material, such as certain inorganic salts or an epoxy bonded ceramic, which is disclosed as becoming frangible upon heating. This frangible tube is disclosed as being removable when the smoker eliminates ash from the end of the article. Even though the appearance of this article is very similar to a conventional cigarette, apparently no commercial product ever has been marketed.

In U.S. Pat. No. 3,738,374, Bennett proposed the use of carbon or graphite fibers, mat, or cloth associated with an oxidizing agent as a substitute cigarette filler. Flavor is provided by the incorporation of a flavor or fragrance into the mouthend of an optional filter tip.

U.S. Pat. Nos. 3,943,941 and 4,044,777 to Boyd et al and British patent No. 1,431,045 proposed the use of a fibrous carbon fuel which is mixed or impregnated with volatile solids or liquids which are capable of distilling or subliming into the smoke stream to provide "smoke" to be inhaled upon burning of the fuel. Among the enumerated smoke producing agents are polyhydric alcohols, such as propylene glycol, glycerol, and 1,3-butylene glycol, and glyceryl esters, such as triacetin. Despite Boyd et al's desire that the volatile materials distill without chemical change, it is believed that the mixture of these materials with the fuel would lead to substantial thermal decomposition of the volatile materials and to bitter off tastes. Similar products are proposed in U.S. Pat. No. 4,286,604 to Ehretsmann et al and in U.S. Pat. No. 4,326,544 to Hardwick et al.

Bolt et al, in U.S. Pat. No. 4,340,072, proposed a smoking article having a fuel rod with a central air passageway and a mouthend chamber containing an aerosol forming agent. The fuel rod preferably is a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent is proposed to be a nicotine source material, or granules or microcapsules of a flavorant in triacetin or benzyl benzoate. Upon burning during use of the article, air enters the air passage where it is mixed with combustion gases from the burning rod. The flow of these hot gases reportedly ruptures the granules or microcapsules to release the volatile material. This material reportedly forms an aerosol and/or is transferred into the mainstream aerosol. It is believed that the articles of Bolt et al, due in part to the long fuel rod, would produce insufficient aerosol from the aerosol former to be acceptable, especially in the early puffs. The use of microcapsules or granules further would appear to impair aerosol delivery because of the heat needed to rupture the wall material. However, total aerosol delivery would appear dependent on the use of a large mass of tobacco or tobacco substitute materials, which would provide substantial pyrolysis products and sidestream smoke. Such attributes would not be desirable in such types of smoking articles.

U.S. Pat. No. 3,516,417 to Moses proposed a smoking article, with a tobacco fuel, which is essentially identical to the article of Bolt et al, tobacco in lieu of the granular or microencapsulated flavorant of Bolt et al. (See FIG. 4, and col. 4 lines 17–35 of the Moses reference.) Similar tobacco-based fuel articles are described in U.S. Pat. No. 4,347,855 to Lanzilotti et al and in U.S. Pat. No. 4,391,285 to Burnett et al. European patent application No. 117,355, by Hearn et al, described similar smoking articles having a pyrolyzed ligno-cellulosic heat source with an axial passageway therein. These articles would be expected to suffer many of the same problems as the articles proposed by Bolt et al.

Steiner, in U.S. Pat. No. 4,474,191, described "smoking devices" containing an air-intake channel which, except during the lighting of the device, is completely isolated from the combustion chamber by a fire resistant wall. To assist in the lighting of the device, Steiner proposed providing a means for allowing the brief, temporary passage of air between the combustion chamber and the air-intake channel. Steiner's heat conductive wall also serves as a deposition area for nicotine and other volatile or sublimable tobacco simulating substances. In one embodiment (FIGS. 9 and 10), the Steiner device is provided with a hard, heat transmitting envelope. Materials reported to be useful for the envelope include ceramics, graphite, metals, etc. In another embodiment, Steiner envisions the replacement of the tobacco (or other combustible material) fuel source with some purified cellulose-based product in an open cell configuration, mixed with activated charcoal. This material, when impregnated with an aromatic substance, is stated to dispense a smoke-free, tobacco-like aroma.

None of the foregoing types of smoking articles have ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

More recently, Sensabaugh et al, in European patent application No. 174,645, described smoking articles having fuel elements, preferably carbonaceous fuel elements, normally in a conductive heat exchange relationship with a substrate bearing an aerosol forming material. Such smoking articles are believed to be capable of providing the benefits and advantages associated with conventional cigarette smoking, without delivering considerable quantities of incomplete combustion and pyrolysis products, and without the many drawbacks associated with the previously mentioned smoking articles. However, in the embodiments described by Sensabaugh et al, such as FIG. 3 in European Patent Application 174,645, air contacting the fuel element and combustion gases produced from the burning fuel element are normally drawn through the article and delivered to the user.

There does not appear to be known a smoking article capable of providing the benefits and advantages associated with conventional cigarette smoking, without delivering considerable quantities of incomplete combustion and pyrolysis products, such as is proposed in the aforementioned Sensabaugh European Patent Application, but wherein the air employed in aerosol formation is precluded from directly contacting with the fuel element.

SUMMARY OF THE INVENTION

The present invention relates to a smoking article which is capable of producing substantial quantities of aerosol, both initially and over the useful life of the product, preferably without significant thermal degradation of the aerosol forming material, and without the presence of substantial combustion products or sidestream smoke. Preferred articles of the present invention are capable of providing the user with the sensations and benefits of cigarette smoking without the necessity of burning tobacco. The articles of this invention minimize or even prevent combustion gases from entering the mouth of the user during draw.

This invention relates to a cigarette-type aerosol delivery article having a heat source, a physically separate aerosol generating means including at least one aerosol forming substance, and a means for the introduction of peripheral air for aerosol generation. In addition, a barrier means normally is provided and is physically separate from, as well as adjacent to, the heat source and the aerosol generating means. The barrier means substantially precludes the combustion gases from passing directly through the article, and the gases employed in aerosol formation from contacting the heat source.

More particularly, this invention relates to a cigarette-type aerosol delivery article normally having an outer member with a means for introducing peripheral air, a heat source, and an aerosol generating means contained within and physically separate from the outer member. The aerosol forming substance is physically separate from the heat source; and at least a portion of the aerosol generating means normally is positioned in a conductive heat exchange relationship with the heat source. Normally, the aerosol generating means is contained within a heat conductive container. Typically, the article also includes a mouthend piece.

In a preferred aspect, the article is arranged to substantially preclude contact between the air used for aerosol generation and the heat source, while the air is within the article. For example, a barrier means can be positioned adjacent to the heat source, while the outer member, aerosol generating means and barrier means can be arranged to substantially preclude the passage of gases from the heat source directly through the article (i.e., within the outer member) and into contact with the aerosol forming substance(s).

In operation, the user initiates (e.g., lights) the heat source which thereby generates heat. The heat is conducted or otherwise transferred to the aerosol generating means and acts to volatilize the aerosol forming substance(s) of the aerosol generating means. When the user draws upon the mouthend of the article, as is done in puffing a conventional cigarette, air enters the periphery of the article, is heated as it passes by, through or near a heat conducting member, and passes through the aerosol generating means where the aerosol forming substances are volatilized. The heated air and the volatile aerosol forming materials then are drawn into the mouth of the user, akin to the smoke of a conventional cigarette.

Advantageously, a heat conductive container contains or encloses a substrate or carrier bearing one or more aerosol forming substances. Preferably, the heat conductive container is manufactured from a metal or ceramic conductor; and the substrate or carrier is a heat stable material in a conductive heat exchange relationship with the heat source. Preferably, the heat conductive container is closed or sealed at its fuel element end and contacts the heat source or is embedded in the heat source to efficiently conduct or transfer heat generated by the heat source to the aerosol forming substance(s).

The heat source preferably is a fuel element such as a carbonaceous fuel element molded or extruded from a combustible carbonaceous material. The fuel element may contain binders and burn additives to improve the lightability thereof. Preferred carbonaceous fuel elements produce minimal pyrolysis or incomplete combustion products, little or no visible sidestream smoke, and minimal ash. Advantageously, the fuel element is about 5 mm to about 30 mm in length. Preferred carbonaceous fuel elements also have high heat capacities. Preferably, the heat conductive container is positioned very near or slightly beyond the extreme lighting end of the fuel element.

The fuel element preferably extends from one extreme end of the article (e.g., the lighting end) along a longitudinal portion of the heat conductive container. Preferably, the fuel element is provided with a central cavity or passage into which the conductive container fits. Such a configuration permits the heat conductive container to be in contact with, close to, or adjacent to the fuel element to provide a heat conductive relationship between the fuel element and the heat conductive container during use of the article. Thus, heat transfer to the conductive container and the resultant production of aerosol is maximized. Because the aerosol forming substance is physically separate from the fuel element, such substance is exposed to lower temperatures than are present in the heat generating (e.g., burning) fuel element, thereby reducing the possibility of thermal degradation of the aerosol forming substance.

The heat conductive container preferably is in the form of a housing including (i) an outer member in the form of a cartridge extending lengthwise within the article having a closed end in contact with the fuel element and an opening spaced from the fuel element to allow air to enter; and (ii) a heat conductive inner container, chamber or tube-like member at least partially within the cartridge being in contact with the outer cartridge, and having at least a portion of the outer cartridge to form at least one air passageway therebetween. The inner container forms at least one air passageway. Preferably, the draw induced airflow entering through perforations in the outer member of the article enters the heat conductive container through the open end of the cartridge. The air drawn into the cartridge is directed so as to come into contact with the aerosol forming substance(s) carried within the inner container or within a nonconductive tube in registry with the inner container, and is then directed to the mouth of the user through an open end of the inner container or nonconductive tube. Flow of peripheral air through the heat conductive housing can be assured by providing barrier means between the fuel element and the aerosol generating means; as well as in a region between the peripheral air openings and the mouthend of the article. Such seals between the fuel element and the aerosol forming substances minimize the possibility that air drawn through the peripheral perforations in the outer member will come into contact with the fuel element. Air seals positioned near the mouthend of the heat conductive container, between the peripheral air openings and the mouthend of the article, assure that the required amount of drawn air passes through the aerosol generating means and not directly into the mouth of the user.

Alternatively, the heat conductive container in the form of a cartridge includes a closed end in the region thereof surrounded by the fuel element; and an open end spaced from the fuel element in the region thereof towards the mouthend of the article. The aerosol forming substance(s) are carried by a substrate or carrier which is positioned within the cartridge. The substrate or carrier is in a heat exchange relationship with the fuel element. Preferably, the draw induced airflow entering through a perforation in the peripheral portion of the outer member of the article enters the heat conductive container through a passageway provided by a tube-like member which extends from the perforation into the cartridge. Flow of peripheral air through the heat conductive container can be assured by providing an air seal between the fuel element and the aerosol generating means in order to minimize the possibility that air drawn therewithin will come into contact the fuel element.

In another embodiment, the heat conductive container in the form of a cartridge includes a closed end embedded in the fuel element; and an open end near the mouthend of the article. The aerosol forming substance(s) are carried by a substrate or carrier positioned within the cartridge, which is in a heat exchange relationship with the fuel element. Preferably, draw induced airflow through perforations in the peripheral portion of the outer member (e.g., through an air permeable outer member) enters the heat conductive container through peripheral perforations therein. Airflow into the heat conductive container can be assured by providing air seals positioned adjacent to the fuel element; as well as near the mouthend of the heat conductive container.

The article of this invention normally is provided with a mouthend piece which extends behind the open or delivery end of the heat conductive container of the aerosol delivery means. The mouthend piece can be provided by a unitary extension of the outer member thereby providing a built-in mouthend piece. Alternatively, the heat source, outer member and aerosol generating means can be provided as a disposable cartridge without a built-in mouthend piece, for use with a separate mouthend piece. In such an embodiment, a seal between the outer member and the mouthend piece provided by a circumscribing wrap such as tape, can assure that the air passes into the article through the perforations, as required. In other embodiments, the separate mouthend piece can be disposable or reusable.

If desired, an insulating member (e.g., an insulating jacket) can circumscribe at least a portion of the heat source and/or the heat conductive container in order to reduce radial heat loss. Preferably, an insulating member is positioned between the heat conductive container and the physically separate outer member.

Preferred embodiments of the invention are capable of delivering at least 0.6 mg of aerosol, measured as wet total particulate matter (WTPM), in the first 3 puffs, when smoked under FTC smoking conditions. (FTC smoking conditions consist of two seconds of puffing (35 ml total volume) separated by 58 seconds of smolder.) More preferred embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of wet total particulate matter per puff for at least about 6 puffs, preferably for at least about 10 puffs, under FTC smoking conditions.

The aerosol delivery article of the present invention also is capable of providing an aerosol which is chemically simple, consisting essentially of air, the aerosol former, and any desired flavorants or other desired volatile materials. This aerosol preferably has no significant mutagenic activity according to the Ames test, Ames et al, *Mut. Res.*, 31:347–364 (1975); Nagals et al, *Mut. Res.*, 42:335 (1977). The preferred articles of this invention, when used, deliver very low levels of carbon monoxide, preferably less than about 2 mg total CO delivery over the life of the article, more preferably less than about 1 mg total CO delivery, most preferably essentially no total CO delivery.

As used herein, and only for the purposes of this application, "aerosol" is defined to include vapors, gases, particles, and the like, both visible and invisible, and especially those components perceived by the user to be "smoke-like," generated by action of the heat from the heat source (e.g., the burning fuel element) upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the term "conductive heat exchange relationship" is defined as a physical arrangement of the aerosol generating means and the heat source whereby heat is transferred by conduction from the heat generating heat source (e.g., burning fuel element) to the aerosol generating means substantially throughout the heat generating period of the heat source. Conductive heat exchange relationships can be achieved by locating the aerosol generating means in contact with the heat source and in close proximity to the heat generating (e.g., burning) portion of the heat source.

As used herein, the term "carbonaceous" means primarily comprising carbon.

As used herein, the term "insulating member" applies to all materials which act primarily as insulators. Preferably, these materials do not burn during use. Insulators also can be slow burning carbon materials, and the like; and materials which fuse during use, such as low temperature grades of glass fibers. Suitable insulators have a thermal conductivity in g-cal/(sec) ($cm^2$) (°C. /cm), of less than about 0.05, preferably less than about 0.02, most preferably less than 0.005. See, *Hackh's Chemical Dictionary,* 34 (4th ed., 1969) and Lange's Handbook of Chemistry, 10, 272–274 (11th ed., 1973).

The article of this invention is described in greater detail in the accompanying drawings and detailed description of the invention which follow.

DETAILED DESCRIPTION OF THE PREFERRED EMBODIMENTS

Figure 1:
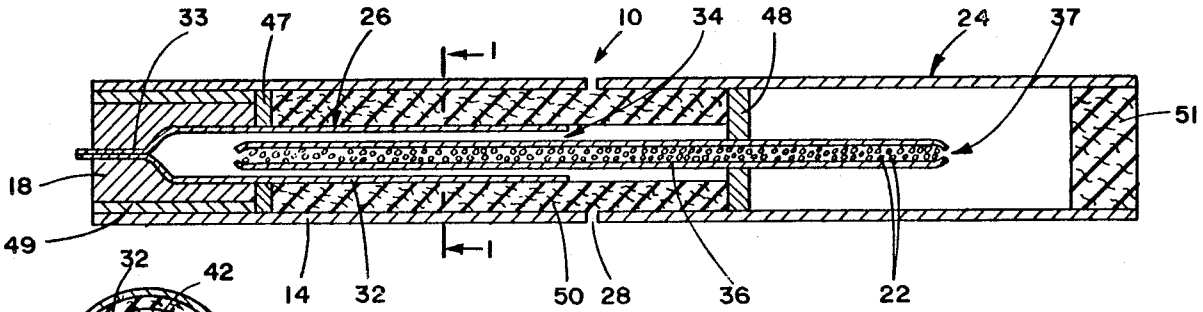
FIGS. 1 through 8 are longitudinal sectional views of various embodiments of the invention.
Figure 6:
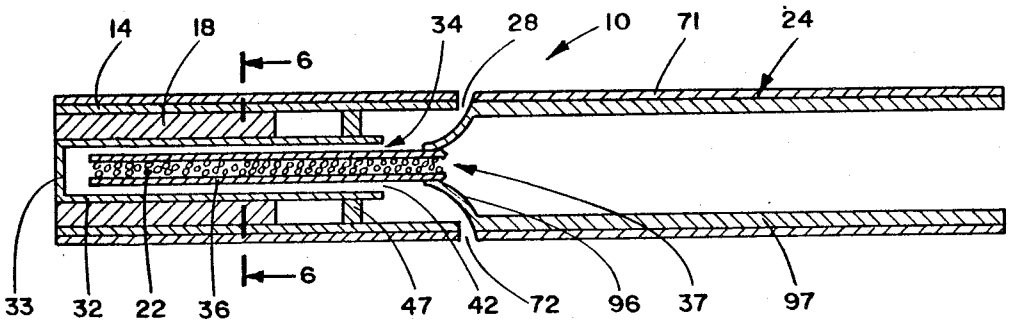
Figure 7:
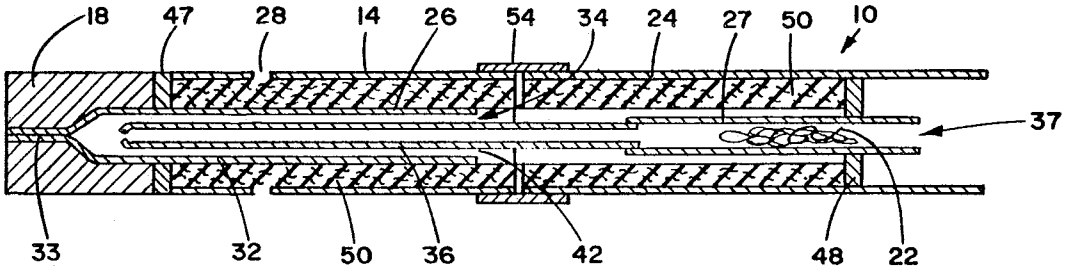
Figure 8:
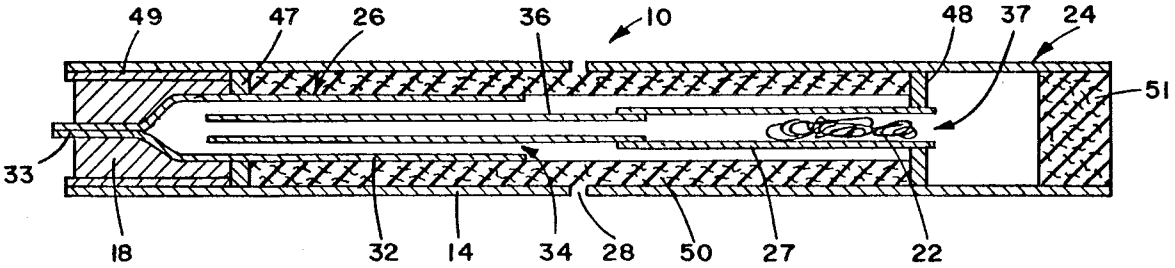

The embodiments of this invention shown in FIGS. 1 through 8 each show an elongated, rod-shaped, cigarette-type aerosol delivery article 10. For example, the embodiments each include an outer member 14 having an elongated or generally tubular shape, a heat source in the form of a combustible fuel element 18, and substrate 22 which carries an aerosol forming substance or substances. The outer member 14 also forms the mouthend portion 24 of the article 10 (as shown in FIGS. 1 and 8) thereby forming an outer container. Alternatively, the mouthend portion 24 can be a separate piece (as shown in FIGS. 2 through 7).

As shown in FIGS. 1 through 6, the aerosol forming substance is in a conductive heat exchange relationship with the fuel element 18 as a result of the heat conductive housing 26 which is in contact with the fuel element, and carries the substrate 22 which in turn carries the aerosol forming substance. As shown in FIGS. 7 and 8, the aerosol forming substance is contained within an essentially nonconductive tube shaped member 27. The nonconductive tube 27 is positioned such that one end is directed towards the mouthend of the article 10, while the other end is in registry with the heat conductive housing 26.

The article 10 also includes at least one peripheral perforation 28 such as in the outer member 14 for providing a source of air within the heat conductive housing 26. Peripheral perforations are positioned such that drawn air enters the article through a region along the length of the article and not through the ends of the article.

Figure 1A:
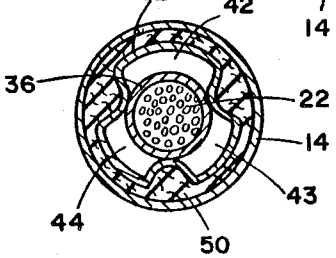
FIG. 1A is a sectional view of the embodiment of FIG. 1, taken along lines 1—1 in FIG. 1.
Figure 2:
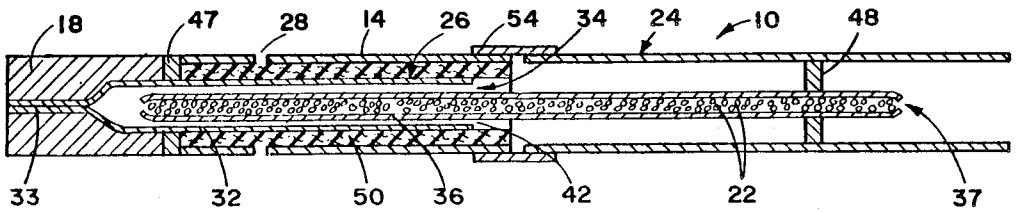

Referring to FIGS. 1 and 2, the fuel element 18 preferably has a length of about 5 mm to about 30 mm, and the heat conductive housing 26 has two parts or portions. The first portion of the housing 26 is an elongated cartridge 32 having a closed end 33 extending into and in contact with the fuel element to provide for conductive heat transfer, and an open end 34 to allow airflow to enter. The second portion of the housing 26 is a tube shaped member 36 which extends into the elongated cartridge 32, contains the substrate 22, provides a region for the formation and/or transfer of aerosol to the mouthend 24 of the article, and has an open end 37 in order to deliver aerosol to the user. Normally, the tube shaped member 36 is in contact with the cartridge 32, as shown in FIG. 1A, in order that the tube shaped member is in a conductive heat exchange relationship with the fuel element 18.

Typically, the outer diameter of the elongated cartridge 32 ranges from about 2 mm to about 8 mm; while the length thereof ranges from about 10 mm to about 80 mm. The outer diameter of the tube 36 is less than the inner diameter of the elongated cartridge and ranges from about 1 mm to about 7 mm; while the length thereof ranges from about 10 mm to about 85 mm. Preferably, the tube 36 extends into the elongated cartridge 32 to a distance of up to about 95 percent of the length of the cartridge.

Preferably, the closed end 33 of the cartridge 32 is surrounded by the fuel element or extends a substantial distance into the fuel element (e.g., from about 10 percent to about 100 percent of the length of the fuel element) in order that the cartridge can be quickly heated by the fuel source, especially when the fuel element is initially lit and during the first few puffs. As shown in FIGS. 1 and 2, cartridge 32 has a portion thereof extending as a flattened heat receiving element or "finger" 33 extending towards the lighting end of the fuel element 18. If desired, (as shown in FIG. 1) the flattened finger 33 of the cartridge 32 can extend beyond the lighting end of the fuel element (e.g., up to about 5 mm beyond the extreme lighting end of the fuel element) in order that heat can be conducted quickly to the aerosol forming substance upon initial ignition of the fuel element.

The front end or closed end 33 of the cartridge 32 can have a variety of shapes. For example, the front region can be rounded, crimped, flattened, machined to have a plurality of conductive "fingers," or the like. Preferably, the cartridge 32 is constructed such that gases generated by the burning fuel element do not pass through the closed end and into the inner region of the cartridge. For example, the crimped end of the cartridge can be sealed tightly with solder or other sealant. In the most preferred embodiment, virtually all of the air which enters the cartridge (i.e., during draw upon the mouthend region 24) does so through the airspaces between the cartridge 32 and the tube 36.

As shown in FIG. 1A, the cartridge 32 is crimped inwardly, particularly toward the mouth end thereof. For example, the cartridge 32 is generally axially crimped at three points around its periphery in order to assist in positioning and supporting the inner tube 36. The crimping also assists in providing contact of the heat conductive cartridge 32 with the heat conductive tube 36 to provide a conductive heat exchange relationship therebetween, as well as between the fuel element 18 and the heat conductive tube 36. The crimping of the cartridge forms a lobe shape thereby providing several void regions which form airspaces 42, 43 and 44 between cartridge 32 and tube 36.

Air seal 47 is positioned at the mouthend of fuel element 18 so as to extend between cartridge 32 and outer member 14 to provide an essentially air impervious barrier which minimizes direct passage of combustion gases from the burning fuel element into the other parts of the article and prevents combustion gases from intermixing with the peripherally introduced air employed in generating aerosol. Air seal 47 is suitably manufactured from metals, ceramics, high temperature plastics such as Zydar which is available from Dartco Mfg., Inc., Augusta, Ga., high temperature silicone rubber sealants, or other such materials. Air seal 47 can be held in place by frictional fit, adhesive, or other such means. Air seal 47 is physically separate from the fuel element 18. By "physically separate" is meant that the seal is neither a part of the fuel element, nor provided by the fuel element; although the seal can abut the fuel element.

Air seal 48 can be similar in construction to air seal 47 and is positioned near the mouthend of tube 36 and forms a seal between the inner region of the mouthend portion or piece 24 and the outer region of tube 36. Air seal 48 provides a seal which minimizes peripherally introduced air entering the article from by-passing the aerosol forming substance. Thus air seal 48 assures that the desired amount of peripherally introduced air is employed in aerosol formation.

The perforations 28 are positioned in the periphery of the outer member 14 in the region thereof between barrier or air seal 47 and air seal 48. As such, air entering the periphery of the article does so in a region longitudinally spaced from the periphery of the fuel element (i.e., contact of the drawn air with the fuel element is minimized or even prevented); and such drawn air can readily pass into the housing 26 through the open end 34 of the cartridge 32. The size or number of the perforations can be varied to provide the desired draw characteristics.

In the embodiment shown in FIG. 1, the fuel element 18 is provided with a peripheral insulating member 49, such as a jacket of insulating fibers (e.g., fiberglass). The insulating member is preferably a porous, nonburning material having a thickness of at least about 0.5 mm. The insulating member can reduce radial heat loss, can assist in retaining and directing heat from the fuel element toward the aerosol generating means, and can reduce the potential fire-causing property of the fuel.

If desired, at least a portion of the conductive housing 26, in the region between the two air seals 47 and 48, can be overwrapped or circumscribed by a peripherally extending insulating member 50 (e.g., fiberglass). The insulating member is preferably a nonburning air permeable material which helps reduce radiant heat loss from the heat conductive container 26, and helps maintain the outer member 14 at a temperature lower than that of the conductive housing 26. The insulating member 50 should have sufficient permeability so as to avoid interferring with the peripheral air flow.

If desired, particularly for aesthetic considerations, a low efficiency filter 51 such as a cellulose acetate or polypropylene filter, can be positioned within the mouthend piece 24 near the extreme mouthend of the article.

The outer member 14 can be manufactured from cigarette paper wrap, cardboard, foil-lined paper, cellulose acetate/plastic, or the like. The mouthend portion or piece 24 can be manufactured from a material such as cardboard, foil-lined paper, cellulose acetate/ plastic, or the like. As shown in FIG. 1, the outer member 14 also forms the mouthend of the article. Alternatively, as shown in FIG. 2, the mouthend portion 24 can be a separate piece which is attached to the outer member 14 by suitable connecting means (e.g., circumscribing air impermeable adhesive tape 54). Friction fit or other means for providing communication can be employed.

When in use, heat delivery is initiated (e.g., the heat source is lit) to generate heat which is conductively transferred via cartridge 32 and tube 36 to the aerosol forming substance carried by substrate 22. During draw on the mouthend of the article, air enters the article through peripheral perforations 28, enters the airspaces 42, 43 and 44 between cartridge 32 and tube 36, and is heated as the air travels toward the fuel end of the article. After reaching the end of the tube 36 at the fuel end thereof, the heated air passes into heated tube 36. The heated air passing through tube 36 then contacts the heated aerosol forming substances carried by substrate 22 to volatilize those substances to form an aerosol, and/or to carry away volatilized substances. This aerosol then is drawn through the mouthend of the article 10 and into the mouth of the user.

Figure 3:
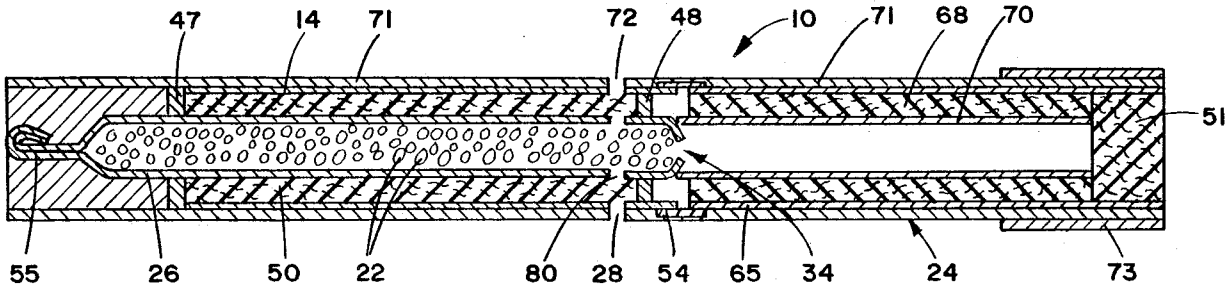
Figure 4:
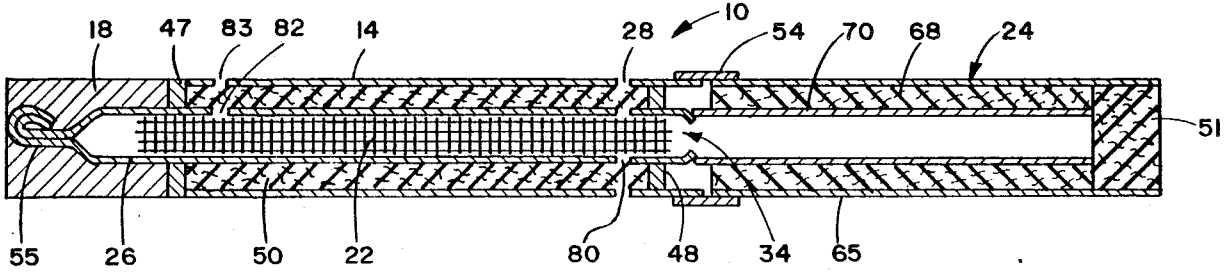

Referring to FIGS. 3 and 4, the fuel element 18 preferably has a length of about 5 mm to about 30 mm, and the heat conductive container 26 has the general shape of an elongated cartridge or capsule. Preferably, the cartridge has a closed end which is embedded in the fuel element to provide for conductive heat transfer, and an open end 34 to allow transfer of the aerosol to the mouthend portion 24 of the article. Typically, the outermost diameter of the capsule ranges from about 2 mm to about 8 mm; while the length thereof ranges from about 10 mm to about 80 mm. Preferably, the closed end of the cartridge is surrounded by the fuel element as for the previously described embodiments. The front end or closed end of the cartridge 26 can have a variety of shapes as for the previously described embodiments. Most preferably, the cartridge is constructed such that gases generated by the burning fuel element do not pass through the closed end and into the inner region of the cartridge. For example, the closed end of the cartridge can have a portion thereof extending as a flattened heat receiving element or "finger" 55 which is bent backward and crimped closed in order to provide for an essentially air-tight seal. Preferably, the flattened finger 55 extends to the endmost tip (i.e., near the extreme lighting end) of the fuel element 18. Air seal 47 is positioned adjacent the fuel element 18, in the manner described hereinbefore. A second air seal 48 extends from the outer region of cartridge 26 adjacent the mouth end of the cartridge, and forms a seal between the cartridge and the outer member 14.

For the embodiment shown in FIG. 3, substrate 22 includes numerous particulates acting as a carrier for the aerosol forming substance. For the embodiment shown in FIG. 4, the substrate 22 is in the form of a fine mesh metal screen wound or folded into a cylindrical shape, which acts as a carrier for the aerosol forming material.

If desired, at least a portion of the cartridge 26 between the air seals 47 and 48 can be overwrapped or circumscribed by a peripheral, air permeable insulating member 50.

The mouthend piece 24 includes an outer wrap 65 such as an essentially air impermeable paper wrap which circumscribes a resilient tube 68 such as a plasticized cellulose acetate tube. Within the resilient tube 68 extends a second resilient, heat resistant tube 70 such as commercially available Kapton provided by E. I. duPont de Nemours, Inc. The second resilient tube 70 abuts (as shown in FIGS. 3 and 4) or preferably overlaps the open end of the cartridge 26 such that aerosol exiting the open end of the cartridge can easily travel through the mouthpiece 24 and into the mouth of the user. Preferably, the second resilient tube 70 overlaps a portion of the cartridge in order to minimize or preferably eliminate leakage of aerosol when traveling from the cartridge 26 to the tube. The mouthend piece 24 is attached to the outer member 14 by suitable connecting means such as circumscribing air impermeable tape 54.

The outer member 14 has a series of peripheral perforations 28, or otherwise has a region of air permeability such as is provided as a result of manufacture from air permeable material. As shown in FIG. 3, the entire article can be wrapped with a circumscribing wrap 71, such as cigarette paper, or the like. The circumscribing wrap can be air permeable so as to allow for air to enter perforations 28 in the outer member. Alternatively, the circumscribing wrap can have at least one perforation 72 therein. Such perforations 72 preferably are provided so as to be in alignment with perforations 28, and thereby allow air to enter into the article upon draw. Furthermore, as shown in FIG. 3, the article can be provided with circumscribing tipping material 73 toward the mouthend of the article in order to assist in providing the appearance of a conventional cigarette.

The cartridge 26 includes a series of perforations 80 in the peripheral region thereof. Preferably, (as in the embodiment shown in FIG. 4) a perforation 82 is positioned near the front of the cartridge in order to act as an air vent. The air vent can provide for an easier transfer of aerosol forming substance in aerosol form from the cartridge.

If desired, as shown in FIG. 4, a series of perforations 82 or air vents can be positioned directly behind the fuel element and air seal 47 in order to provide a small amount of side stream aerosol during smolder through various perforations 83 in the outer member 14. Such side stream aerosol provides a convenient means by which the user can identify whether the article is capable of forming aerosol (e.g., whether the fuel element is generating heat and/or whether the cartridge 26 contains sufficient aerosol forming substance to generate aerosol during draw).

When in use, heat delivery is initiated (e.g., the heat source is lit) to generate heat which is conductively transferred via cartridge 26 to the aerosol forming substance carried by substrate 22. During draw on the mouthend of the article, air enters 24 the article through the series of perforations 28 or through the air permeable outer material of the outer member 14 and into the cartridge 26 through perforations 80 therein. The air entering the cartridge 26 contacts the heated aerosol forming substances to form an aerosol and/or to carry away volatilized substances. This aerosol then is drawn through the mouthend of the article and into the mouth of the user.

Figure 5:
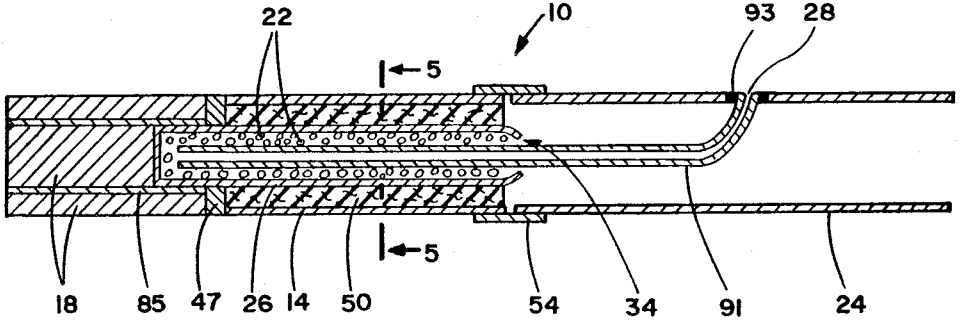

Referring to FIG. 5, the fuel element 18 preferably has a length of about 5 mm to about 30 mm, and the heat conductive container 26 has the general shape of a cartridge. Preferably, the cartridge has a closed end which abuts and advantageously is embedded in the fuel element to provide for conductive heat transfer, and an open end 34 to allow transfer of the aerosol to the mouthend 24 of the article. The cartridge can have a size and configuration as for the previously described embodiments. Preferably, the cartridge includes a heat gathering crown-like member 85 protruding in a "finger-like" fashion to the lighting end the fuel element 18, thereby providing for conductive heat transfer to the aerosol forming substance for aerosol formation during early and middle puffs. Air seal 47 can be positioned as described hereinbefore. The mouthend piece 24 is manufactured from substantially air impermeable material.

Figure 5B:
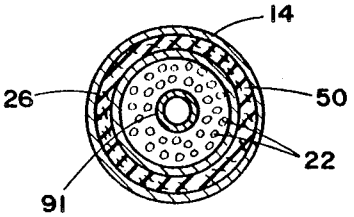
FIG. 5B is a sectional view of the embodiment of FIG. 5, taken along lines 5—5 in FIG. 5.
Figure 5A:
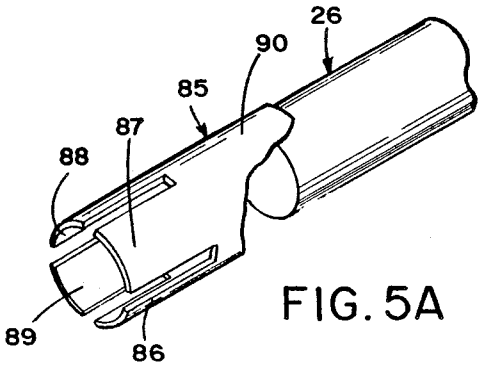
FIG. 5A is a perspective of a portion of the embodiment of FIG. 5 showing the crown-like heat conductive member and a portion of heat conductive cartridge.

As shown in FIG. 5A, a portion of the crown-like member 85 (a portion of which is shown as cut away) overlaps a portion of the heat conductive container 26 toward the closed end of the container 26. The crown-like member 85 includes four spaced apart heat conductive members or "fingers" 86, 87, 88 and 89 extending to the end which corresponds to the extreme lighting end of the article from the tube-like portion 90 of the crown-like member.

The peripheral perforation 28 has an air transfer means 91 such as a tube connected therefrom and extending through the open end 34 of the cartridge 26. Preferably the tube 91 extends a substantial distance into cartridge 26, for example, up to a distance of about 95 percent of the length of the cartridge.

The tube 91 preferably is heat resistant, and can be manufactured from metal, ceramics, high temperature polymers or plastics, or other such materials. Typically, the outer diameter of the tube ranges from about 0.5 mm to about 3 mm. Tube 91 is provided with a seal at the perforation with adhesive material 93 to prevent air leak.

As shown in FIG. 5B, the hollow tube 91 extends into the cartridge 26. The cartridge contains the substrate 22 which in turn carries the aerosol forming substance. The substrate 22 is in a conductive heat exchange with the cartridge 26.

When in use, heat delivery is initiated (e.g., the heat source is lit) to generate heat which is transferred to the conductive cartridge, which in turn heats the aerosol forming substance carried by the substrate 22. During draw on the mouthend of the article, air enters the article 10 through peripheral perforation 28 into tube 91. Air passing through tube 91 towards the fuel element then passes into the cartridge 26. The air exits the end of the tube near the fuel end of the article and contacts the aerosol forming substances carried by substrate 22 within the cartridge 26 to volatilize those substances to form an aerosol and/or to carry away volatilized substances. This aerosol then is drawn through the mouthend of the article and into the mouth of the user.

Figure 6A:
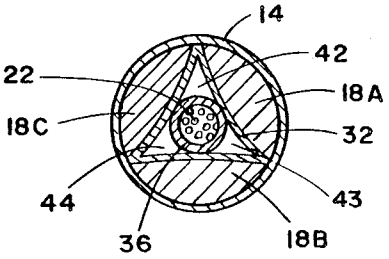
FIG. 6A is a sectional view of the embodiment of FIG. 6, taken along lines 6—6 in FIG. 6.

Referring to FIGS. 6 and 6A, the fuel element 18 has three parts or portions 18A, 18B and 18C (see FIG. 6A), and preferably has a length of about 30 mm or less. The elongated heat conductive container or cartridge 32 has a closed end 33, an open end 34, and a generally triangular cross sectional shape, as shown in FIG. 6A. The closed end of the cartridge extends to very near the extreme lighting end of the fuel element; and the fuel element is constructed to extend along the length of the cartridge. The cartridge 32 extends beyond the mouthend portion of the fuel element 18. The cartridge can be constructed from aluminum foil, or other heat conductive material. Air seal 47 is positioned adjacent the fuel element 18 toward the mouthend of the fuel element between the cartridge 32 and the outer member 14. Preferably, the outer member 14 is a circumscribing cigarette paper wrap, or the like. Tube 36, which can be constructed from heat conductive material such as aluminum foil, or the like, is positioned so as to extend into the cartridge 32 and is held in place therein by frictional contact. The tube 36 extends into the cartridge to a distance of up to about 95 percent of the length of the cartridge. Substrate 22, which carries the aerosol forming substances, is contained in the tube 36. The tube 36 is in communication with a mouthend piece 24 which has an outwardly extending portion 96 which forms an air seal and a tubular section 97 having an outer diameter approximating that of the article 10. Typically, the mouthend piece overlaps a rear portion of the tube 36 and is held in place by friction fit.

As the tube 36 is heat conductive and can reach relatively high temperatures, the mouthend piece 24 preferably is constructed from a heat resistant nonconductive material such as ceramic, or the like. Preferably, the entire article is circumscribed by wrap 71. Perforations 72 are provided in the circumscribing wrap 71 so as to expose air inlet region 28 between the mouthend extension of the outer member and the mouthend piece. Thus, upon drawing on the mouthend of the article, air enters perforations 72 and air inlet region 28. The drawn air is directed through airspaces 42, 43 and 44 (see FIG. 6A) between cartridge 32 and tube 36, and then into tube 36. Air passing through tube 36 contacts the aerosol forming substance to form an aerosol and/or to carry volatilized substances and into the mouthend of the article to the user.

Referring to FIGS. 7 and 8, the fuel element 18 preferably has a length of about 5 mm to about 30 mm, and the heat conductive housing 26 has two parts or portions. The first portion of the housing 26 is an elongated cartridge 32 having a closed end 33 extending into and in contact with the fuel element to provide for conductive heat transfer; and an open end 34 to allow airflow to enter. The second portion of the housing 26 is a heat conductive tube shaped member 36 which can be positioned so as to be in registry with a nonconductive member such as tube 27. The nonconductive tube 27 contains the substrate 22 which in turn carries the aerosol forming substance(s). A preferred substrate 22 is a carbon fiber material.

Air entering the open end 34 of cartridge 32 can travel into the cartridge and be heated, through the heat conductive tube 36 where it is also heated, and into the nonconductive tube 27 thereby providing for formation and transfer of aerosol to the mouthend 24 of the article. Normally, the conductive tube 36 is in contact with the cartridge 32 (as described hereinbefore) in order that the conductive tube is in a conductive heat exchange relationship with the fuel element 18.

Typically, the outer diameter of the elongated cartridge 32 ranges from about 2 mm to about 8 mm, while the length thereof ranges from about 10 mm to about 80 mm. The outer diameter of the heat conductive tube is less than the inner diameter of the cartridge and ranges from about 1 mm to about 7 mm; while the length thereof ranges from about 10 mm to about 85 mm. The heat conductive tube 36 extends into the cartridge 32 to a distance of up to about 95 percent of the length of the inner portion of the cartridge. The total length of the heat conductive housing 26 depends upon a variety of factors, but generally is great enough to provide for the heating of air passing therethrough during use of the article. Typically, the total length of the heat conductive housing ranges from 10 mm to 110 mm.

Preferably, the closed end of the cartridge 32 is surrounded by the fuel element or extends a relatively great distance into the fuel element in order that the cartridge can be quickly heated by the heat source, especially when the fuel element is initially lit and during the first few puffs. As shown in FIGS. 7 and 8, cartridge 32 has a portion thereof extending as a flattened heat receiving element or "finger" 33 extending towards the lighting end of the fuel element 18. If desired (as shown in FIG. 8) the flattened finger of the capsule can actually extend beyond the lighting end of the fuel element in order that heat from the lighting means as well as the fuel element is conducted quickly to the remaining portion of the heat conductive housing upon initial ignition. The front end or closed end 33 of the cartridge 32 can have a variety of shapes. Preferably, the cartridge 32 is constructed such that gases generated by the burning fuel element do not pass through the closed end thereof, and into the inner region of the cartridge. In the most preferred embodiment, virtually all of the air entering the cartridge (i.e., during draw upon the mouthend region 24) does so through airspaces between the cartridge 32 and the heat conductive tube 36. The cross sectional configuration of the heat conductive housing is similar to that configuration illustrated in FIG. 1A.

The nonconductive tube 27 is in registry with the heat conductive tube 36. By this is meant that drawn air flowing into the cartridge and the heat conductive tube 36 passes through the nonconductive tube and into the mouthend region of the article. The manner of providing the registry or flow communication can vary. For example, the heat conductive tube 36 and the nonconductive tube 27 can be positioned in an abutting end-to-end relationship and held in place by a heat resistant sealant, or the nonconducting tube can be inserted over the region adjacent the end of the conductive tube in an overlapping relationship and can be held in place by a friction fit. The distance which the nonconductive tube 27 extends from the mouth end of the conductive tube 36 can vary, and typically ranges from 10 mm to 80 mm.

Air seal 47 is positioned at the mouthend of the fuel element so as to form a seal between cartridge 32 and outer member 14. Air seal 48 is positioned near the extreme mouthend of nonconductive tube 27 and provides a seal which assures that air entering the article is employed in aerosol formation.

For the preferred embodiments, at least a portion of the housing 26 and the nonconductive tube 27 are overwrapped or circumscribed by a peripherally extending insulating member 50. The insulating member 50 is preferably a nonburning material such as fiberglass which helps reduce radiant heat loss from the heat conductive housing 26, as well as assist in maintaining the outer member 14 at a temperature lower than that of the conductive housing 26.

When in use, heat delivery is initiated (e.g., the heat source is lit) to generate heat which is conductively transferred to conductive housing 26. Thus, air within the housing is heated. During draw on the mouthend of the article, air enters the article through peripheral perforations 28, enters the airspaces 42, 43 and 44 between cartridge 32 and tube 36, and is heated. The air within the housing 26 passes through the capsule 32 towards the fuel end of the article. The air then passes into the heat conductive tube 36. The heated air passes from the heated conductive tube into the nonconductive tube 27 and thereby contacts the aerosol forming substances carried by the substrate 22 to volatilize those substances to form an aerosol. The contact of the heated air and the aerosol forming substance (e.g., the convective heating of the aerosol forming substance) results in the formation of an aerosol which then is drawn through the mouthend of the article and into the mouth of the user.

For the various embodiments, the heat source is most preferably a combustible fuel element. The preferred fuel element is relatively short, and the hot region (i.e., a burning fire cone) is close to or in contact with the heat conductive housing. Such a configuration maximizes heat transfer to the aerosol generating means as well as production of aerosol, especially when the heat conducting cartridge is used. Due to the relatively small size and burning characteristics of the preferred carbonaceous fuel element, burning can begin over most of the length of the fuel element within a few puffs. Thus, the portion of the fuel element adjacent to the aerosol generating means becomes hot quickly, which significantly increases heat transfer to the aerosol generating means, especially during the early and middle puffs. Because the preferred fuel element is short, there is not a long section of nonburning fuel to act as a heat sink. In addition, the optional insulation tends to confine, direct and concentrate the heat toward the central core of the article, thereby increasing the heat transferred to the aerosol generating means.

The aerosol forming substance is physically separate from the fuel element thereby being exposed to substantially lower temperatures than are present in the burning fire cone. Thus, the possibility of the thermal degradation of the aerosol former, and the attendant off taste, is minimized. The physical separation of the aerosol forming substance and the fuel element results in aerosol production during puffing, but minimal aerosol production during smolder, for most embodiments. In addition, the use of a carbonaceous fuel element, the physically separate aerosol generating means, and minimal contact of drawn air with the burning fuel element eliminates substantial combustion products from reaching the user, and can avoid the undesirable production of substantial visible sidestream smoke. Furthermore, the aerosol forming substance within the inner container, tube or cartridge does not come into contact with the fuel element, thereby avoiding migration of the aerosol forming substance to the fuel element.

The preferred embodiments, the short carbonaceous fuel element, the heat conducting cartridge and the optional insulating member each cooperate with the aerosol forming substance in order to provide an article capable of producing substantial quantities of aerosol on virtually every puff.

In general, the fuel elements employed in practicing the invention are less than about 30 mm long. Normally, the fuel element is about from about 10 mm to about 25 mm in length. Desirable fuel elements are less than about 15 mm in length. Advantageously, the diameter of the fuel element is about 10 mm or less, preferably about 8 mm. Although not particularly critical, the density of the carbonaceous fuel elements normally is greater than 0.7 g/cc. as measured, for example, by mercury displacement. In most cases, a high density material is desired because it helps to ensure that the fuel element burns long enough to simulate the burning time of a conventional cigarette and that the fuel element provides sufficient energy to generate the required amount of aerosol.

The fuel elements employed herein are advantageously molded or extruded from comminuted tobacco, reconstituted tobacco, or tobacco substitute materials, such as modified cellulosic materials, degraded or prepyrolyzed tobacco, and the like. Suitable materials include those described in U.S. Pat. No. 4,347,855 to Lanzilotti et al, U.S. Pat. No. 3,931,824 to Miano et al, and U.S. Pat. Nos. 3,885,574 and 4,008,723 to Borthwick et al and in Sittig, Tobacco Substitutes, Noyes Data Corp. (1976). Other suitable combustible materials may be employed, as long as they burn long enough to simulate the burning time of a conventional cigarette and generate sufficient heat for the aerosol generating means to produce the desired level of aerosol from the aerosol forming material.

Preferred fuel elements normally include combustible carbon materials, such as those obtained by the pyrolysis or carbonization of cellulosic materials, such as wood, cotton, rayon, tobacco, coconut, paper, and the like. In most cases, combustible carbon is desirable because of its high heat generating capacity and because it produces only minimal amounts of incomplete combustion products. Preferably, the carbon content of the fuel element is about 20 to about 40 percent by weight, or more.

The most preferred fuel elements useful in practicing this invention are carbonaceous fuel elements (i.e., fuel elements primarily comprising carbon). Preferably, the carbon content of the carbonaceous fuel element is at least about 65 percent, most preferably at least about 80 percent, or more, by weight. High carbon content fuels are preferred as such fuels produce minimal pyrolysis and incomplete combustion products, little or no visible sidestream smoke as well as minimal ash, and have a high heat capacity. However, lower carbon content fuel elements (e.g., having a carbon content of about 50 percent to about 65 weight percent), are useful, especially where a nonburning inert filler is used.

In most instances, the carbonaceous fuel element contains additives and possesses the capability of being ignited by a conventional cigarette lighter. Burning characteristics of this type can generally be obtained from a cellulosic material which has been pyrolyzed at temperatures between about 400° C. to about 1000° C., preferably between about 500° C. to about 950° C., more preferably between about 650° C. to 750° C., in an inert atmosphere, or under a vacuum. The pyrolysis time is not believed to be critical, as long as the temperature at the center of the pyrolyzed mass has reached the aforesaid temperature range for at least a few minutes, e.g., about 15 minutes. A slow pyrolysis, employing gradually increasing temperatures over many hours is believed to produce a more uniform material with a higher carbon yield. The pyrolyzed material then can be cooled, ground to a fine powder, and heated in an inert gas steam at a temperature between about 650° to 750° C. to remove volatiles prior to further processing.

A preferred carbonaceous fuel element is a molded, pressed, or extruded carbon mass prepared from carbon and a binder, by conventional molding or extrusion techniques. Suitable activated carbons for such a fuel element include PC. B-G which is commercially available from Calgon Carbon Corporation, Pittsburgh, PA; and suitable non-activated carbons include PXC which is commercially available from Calgon Carbon Corporation. Other carbons for pressure forming and/or extrusion are prepared from pyrolyzed cotton or pyrolyzed papers, such as Grande Prairie Canadian Kraft, available from the Buckeye Cellulose Corporation of Memphis, Tenn.

The binders useful in preparing fuel elements are well known in the art. A preferred binder is sodium carboxymethylcellulose (SCMC), which may be used alone, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

The amount of binder which is employed can vary, but is limited to minimize contribution of the binder to undesirable combustion products. On the other hand, sufficient binder is included to hold the fuel element together during manufacture and use. The amount used will thus depend on the cohesiveness of the carbon in the fuel element.

In general, an extruded or molded carbonaceous fuel may be prepared by admixing from about 50 to about 99, preferably about 80 to 95, more preferably about 85 to about 92 weight percent of the carbonaceous material, with from about 1 to about 50, preferably about 5 to about 20, more preferably about 8 to about 15 weight percent of the binder, and with sufficient water to make a paste having a stiff dough-like consistency. The dough is then molded or extruded using a suitable mold or a standard ram or piston type extruder the desired shape is thereby provided. The fuel element can be dried, preferably at about 95° C. to reduce the moisture content to about 2 to about 7 percent by weight.

Preferably, the fuel elements employed in this invention contain one or more additives to improve or modify the burning characteristics of the fuel element. For example, an oxidizing agent or the like can be incorporated into the carbonaceous fuel element in order to render the fuel element ignitable by a cigarette lighter. In particular, materials such as potassium nitrate, sodium nitrate, potassium carbonate, zirconium, or the like, can be employed as burn additives and can improve the lightability of the carbonaceous fuel element. The amount of burn additive in the fuel element can vary, and generally ranges from about 2 percent to about 15 percent, preferably from about 5 percent to about 10 percent, based on the total weight of the fuel element.

If desired, an additive such as sodium chloride can be employed in the fuel element an amount of up to about 5 percent, based on the total weight of the fuel element. The sodium chloride additive can improve the smoldering characteristics of the fuel element and can act as a glow retardant. Alternatively, additives such as clays (e.g., attapulgites, serpentines and kaolins) can improve the physical characteristics of the fuel element.

The aerosol forming substance used in practicing the invention is physically separate from the heat source. By "physically separate" is meant that the substrate or carrier which contains the aerosol forming or generating materials is not mixed with, or is not a part of the heat source. As noted previously, this arrangement helps reduce or eliminate thermal degradation of the aerosol forming material and the presence of sidestream smoke. While not a part of the heat source, the aerosol generating means is preferably in a conductive heat exchange relationship with the heat source. Most desirably, the conductive heat exchange relationship is provided by the heat conductive housing which is positioned between the heat source and the substrate which carries or contains the aerosol forming substance.

Preferably, the aerosol generating means includes one or more thermally stable materials which carry one or more aerosol forming materials. As used herein, a thermally stable material is one capable of withstanding the high temperatures, (e.g., about 400° C. to about 600° C.), which exist near the fuel without decomposition or burning. While not preferred, other aerosol generating means, such as heat rupturable microcapsules, or solid aerosol forming substances, are useful, provided such aerosol generating means are capable of releasing sufficient aerosol forming vapors to satisfactorily resemble tobacco smoke. In addition, it is possible to employ a charge of tobacco as part of the aerosol generating means.

Thermally stable materials which can be used as a substrate or carrier for the aerosol forming materials are well known to those skilled in the art. Useful substrates are porous and are capable of retaining an aerosol forming material when not in use, while being capable of releasing a potential aerosol forming vapor upon heating by the fuel element.

Useful thermally stable materials include thermally stable adsorbent carbons, such as porous grade carbons, graphite, activated or nonactivated carbons, carbon fibers, carbon yarns, and the like. Other suitable materials include inorganic solids such as ceramics, glass, aluminum pellets, alumina, vermiculite, clays such as bentonite, and the like. Suitable carbon substrate materials include porous carbons such as PC-25 and PG-60 available from Union Carbide; and SGL carbon available from Calgon. An example of a suitable alumina substrate is SMR-14-1896, available from the Davidson Chemical Division of W. R. Grace & Co., which is sintered at elevated temperatures, (e.g., greater than 1000° C), washed, and dried prior to use. An example of a preferred carbon fiber substrate is commercially available as Kynol Catalogue No. CFY-020Y-3 from American Kynol, Inc., New York, N.Y.

Suitable particulate substrates also can be formed from carbon, tobacco, or mixtures of carbon and tobacco, into densified particles in a one-step process using a machine made by Fuji Paudal KK of Japan, and sold under the trade name of "Marumerizer". This apparatus is described in German patent No. 1,294,351 and U.S. Pat. No. 3,277,520 (now reissued as No. 27,214) as well as Japanese published specification No. 8684/1967.

The aerosol forming substances or materials used in the invention are capable of forming an aerosol at the temperatures present in the aerosol generating means when heated by the burning fuel element. Such materials preferably are composed of carbon, hydrogen and oxygen, but they can include other materials. The aerosol forming materials can be in solid, semisolid, or liquid form. The boiling point of the material and/or the mixture of materials generally range up to about 500° C. Substances having these characteristics include polyhydric alcohols, such as glycerin and propylene glycol, as well as aliphatic esters of mono-, di-, or poly-carboxylic acids, such as methyl stearate, dimethyl dodecandioate, dimethyl tetradecandioate, and others.

The preferred aerosol forming materials are polyhydric alcohols, or mixtures of polyhydric alcohols. Especially preferred aerosol formers are glycerin, propylene glycol, triethylene glycol, propylene carbonate, or mixtures thereof.

The aerosol forming material can be dispersed on or within the aerosol generating means in a concentration sufficient to permeate or coat the substrate, carrier, or container. For example, the aerosol forming substance can be applied full strength or in a dilute solution by dipping, spraying, vapor deposition, electrostatic deposition, or similar techniques. Solid aerosol forming components can be admixed with the substrate and distributed evenly throughout prior to formation.

While the loading of the aerosol forming material can vary from carrier to carrier and from aerosol forming material to aerosol forming material, the amount of liquid aerosol forming materials can generally vary from about 20 mg to about 120 mg, preferably from about 35 mg to about 85 mg, and most preferably from about 45 mg to about 65 mg. As much as possible of the aerosol former carried on the aerosol generating means should be delivered to the user as WTPM. Preferably, above about 2 weight percent, more preferably above about 15 weight percent, and most preferably above about 20 weight percent of the aerosol former carried on the aerosol generating means is delivered to the user as wet total particulate matter (WTPM).

The aerosol generating substance also can include one or more volatile flavoring agents, such as menthol, vanillin, artificial coffee, tobacco extracts, tobacco particles (e.g., a charge of tobacco), nicotine, caffeine, liquors, and other agents which impart flavor to the aerosol. The aerosol generating substance can be any other desirable volatile solid or liquid materials. Alternatively, these optional agents can be placed between the aerosol generating means and the mouthend, such as in a separate substrate or chamber in the passage which leads from the aerosol generating means to the mouthend of the article.

Articles of the type disclosed herein can be used, or can be modified for use, as drug delivery articles, for delivery of volatile pharmacologically or physiologically active materials such as ephedrine, metaproterenol, terbutaline or the like.

The heat conductive container is typically a metallic (e.g., aluminum, copper, brass, stainless steel, or the like) material or a conductive ceramic material which provides the desired degree of heat transfer. The heat conductive container can extend beyond the lighting end of the fuel element. In general, the heat conductive container is positioned up to about the extreme lighting end of the fuel element to avoid any interference with the lighting of the fuel element, but close enough to the lighting end to provide conductive heat transfer during lighting as well as the early and middle puffs.

Preferably, the heat conductive container encloses the aerosol forming materials. Alternatively, a separate portion of the conductive container may be provided, especially in embodiments which employ particulate substrates or semi-liquid aerosol forming materials. In addition to acting as a container for the aerosol forming materials and as part of the barrier between the fuel element and the aerosol generating means, the conductive container improves heat distribution to the aerosol forming materials and helps to prevent migration of the aerosol former to other components of the article. The container also helps provide a means for controlling the pressure drop through the article, by varying the number, size, and/or position of the passageways and openings through which air is delivered to the container, and through which the aerosol former is delivered to the mouthend piece of the article.

The insulating members which can be employed in practicing the invention are preferably formed into a porous, resilient jacket from one or more layers of an insulating material. Advantageously, this jacket is at least 0.5 mm thick, preferably at least 1 mm thick, and more preferably from about 1.5 to 2.0 mm thick. Preferably, the jacket extends over more than half the length of the fuel element. More preferably, it extends over substantially the entire outer periphery of the fuel element and all or a portion of the heat conductive housing. However, insulation of the cartridge can be provided by an airspace between the cartridge and the outer member.

Insulating members which can be used in accordance with the present invention generally comprise inorganic or organic fibers such as those made out of glass, alumina, silica, vitreous materials, mineral wool, carbons, silicons, boron, organic polymers, cellulosics, and the like, including mixtures of these materials. Nonfibrous insulating materials, such as silica aerogel, pearlite, glass, and the like, formed in mats, strips or other shapes, also can be used. Preferred insulating materials should fuse during use and preferably should have a softening temperature below about 650° C. Preferred insulating materials also should not burn during use. However, slow burning carbons and like materials may be employed. These materials act primarily as an insulating jacket, retaining and directing a significant portion of the heat formed by the burning fuel to the aerosol generating means. Because the insulating jacket becomes hot adjacent to the burning fuel element, to a limited extent, it also can conduct heat toward the aerosol generating means.

Preferred insulating materials for the fuel element include ceramic fibers, such as glass fibers. Two suitable glass fibers are available from the Manning Paper Company of Troy, N.Y., under the designations Manniglas 1000 and Manniglas 1200. Preferred glass fiber materials have a low softening point, (e.g., below about 650° C. using ASTM test method C338-73). Preferred glass fibers include experimental materials produced by Owens-Corning of Toledo, Ohio under the designations 6432 and 6437, which have a softening point of about 640° C. and fuse during use.

In the embodiments of the invention, the fuel/aerosol generating means combination is attached to a mouthend piece, such as a foil lined paper or cellulose acetate/plastic tube, although a mouthend piece may be provided separately, as in the form of a cigarette holder. The mouthend piece provides a passageway which channels the vaporized aerosol forming materials into the mouth of the user. Due to its length, the mouthend piece also keeps the hot fire cone away from the mouth and fingers of the user and provides sufficient time for hot aerosol to form and cool before it reaches the user.

Suitable mouthend pieces should be inert with respect to the aerosol forming substances, may have a water or liquid proof inner layer, should offer minimum aerosol loss by condensation or filtration, and should be capable of withstanding the temperature experienced thereby. Preferred mouthend pieces include the cellulose acetate tube which acts as a resilient outer member and helps simulate the feel of a conventional cigarette in the mouth end portion of the article. In certain instances, a cardboard tube can form a suitable mouthend piece. Other suitable mouthend pieces will be apparent to those of ordinary skill in the art.

Mouthend pieces useful in articles of the invention may include an optional "filter" tip, which is used to give the article the appearance of the conventional filtered cigarette. Such filters include low efficiency cellulose acetate filters; hollow or baffled plastic filters, such as those made of polypropylene; or polypropylene fibers such as nonwoven scrip or tow. Such filters do not appreciably interfere with aerosol delivery.

The entire length of article or any portion thereof can be overwrapped with cigarette paper. Preferred papers wrapping the fuel element end of the article should not openly flame during burning of the fuel element. In addition, the paper should have controllable smolder properties and should produce a gray, cigarette-like ash. If desired, the paper can be treated behind the fuel element with a burn suppressant such as sodium silicate.

In those embodiments utilizing an insulating jacket wherein the paper burns away from the jacketed fuel element, maximum heat transfer is achieved because air flow to the fuel source is not restricted. However, papers can be designed to remain wholly or partially intact upon exposure to heat from the burning fuel element. Such papers provide restricted air flow to the burning fuel element, thereby helping to control the temperature at which the fuel element burns and the subsequent heat transfer to the aerosol generating means.

To maximize aerosol delivery which otherwise would be undesirably diluted by radial (i.e., outside) air infiltration through the article, a non-porous paper can be used as the outer member and/or as an outer wrap. If desired, the non-porous paper can extend from the aerosol generating means to the mouth end. Papers such as these are known in the cigarette paper art and combinations of such papers can be employed to produce various functional effects. Suitable papers include Ecusta 01788 and 646 plug wrap manufactured by Ecusta of Pisgah Forest, North Carolina; and papers sold as KC-63-5, P 878-5, P 878-16-2, and 780-63-5 by Kimberly-Clark Corp. Peripheral air is provided to the article by one or more perforations or openings in the outer member. The number, size and positioning of the perforations can vary and is a matter of choice. Typically, the perforations provide sufficient peripheral air in order that the article exhibits a draw comparable to that of a conventional cigarette.

The following examples are provided in order to further illustrate the invention but should not be construed as limiting the scope thereof. Unless otherwise noted, all parts and percentages are by weight.

EXAMPLE 1

A smoking article substantially as illustrated in FIG. 2 is manufactured according to the following procedure.

A. Aerosol Delivery Means Preparation

An aluminum tube having a length of 55 mm, an outer diameter of 2.0 mm and an inner diameter of 1.8 mm is provided. A second aluminum tube having a length of 35 mm, an outer diameter of 4.5 mm, and an inner diameter of 4.4 mm is fashioned into a capsule or cartridge by drawing the tube through a die in order to form a tri-lobed shape (as shown in FIG. 1A). One end of the second tube is crimped closed over a 5 mm distance along the length thereof. The 55 mm aluminum with about 100 mg of an aerosol forming material and substrate.

The substrate is a high surface area alumina (surface area is 280 $m^2/g$) as is obtained as SMR-14-1896 from W. R. Grace & Co. The alumina has a mesh size from −8 to +14 (U.S.). The alumina is sintered at a soak temperature above about 1400° C. for about 1 hour and then cooled, washed with water, and then dried.

The mixture of substrate and aerosol forming material is provided by mixing 77.47 percent of the previously described alumina, 7.5 percent spray dried flue cured tobacco extract, 13 percent glycerin, 0.32 percent levulinic acid, 1.45 percent of a flavorant composition T-69-22 obtained from Firmenich of Geneva, Switzerland, and 0.26 percent glucose pentaacetate.

The tobacco extract used in this example is prepared as follows: Flue cured tobacco is ground to a medium dust and extracted with water in a stainless steel tank at a concentration of from about 1 to about 1.5 pounds tobacco per gallon water. The extraction is conducted at ambient temperature using mechanical agitation for from about 1 hour to about 3 hours. The admixture is centrifuged to remove suspended solids and the aqueous extract is spray dried by continuously pumping the aqueous solution to a conventional spray dryer, such as an Anhydro Size No. 1, at an inlet temperature of from about 215° C. to about 230° C., and collecting the dried powder material at the outlet of the drier. The outlet temperature varies from about 82° C. to about 90° C.

The 55 mm aluminum tube containing the aerosol forming material and substrate is crimped slightly at each end in order to maintain the substrate within the tube. The tube is inserted into the open end of the aforementioned cartridge to a distance of about 25 mm. The tri-lobed arrangement of the cartridge acts to hold the tube in place by a snug friction fit. The overall length of the housing so provided is about 65 mm.

B. Fuel Source Preparation

Hardwood pulp is carbonized under nitrogen atmosphere at 550° C. for 2 hours and cooled over a 2 hour period as the oven temperature declines. Separately, kapok is carbonized under the previously described conditions. A mixture of 90 parts carbonized kapok and 10 parts sodium carboxymethyl cellulose (sold commercially as Hercules 7 HF) is mixed at ambient temperature with enough water to make a thick paste having a moisture content of about 80 percent. The fuel source is provided by mixing 25 g of the carbonized hardwood pulp, 12.58 g of the carbonized kapok/sodium carboxymethyl cellulose mixture, 3.95 g of the previously described sodium carboxymethylcellulose, 2.8 g zirconium and enough water to provide a thick paste.

The mold used to prepare the carbon fuel segment includes two identical metal blocks into which a groove is cut on one side in order that a cylindrical passage is formed when the two blocks are placed together. Each groove is lined with aluminum foil. The foil is used to prevent the sticking of the carbon paste to the metal mold.

The carbonaceous paste is coated in the molds. In one mold, the metal aerosol delivery means is centered within the paste. Ring spacers along the periphery of the tube holds the tube centered within the carbon paste. The crimped end of the cartridge extends to the end of the mold. The two paste filled molds are then clamped together and the carbon paste is dried at about 100° C for about 8 hours. When the mold is taken apart, the aluminum foil is removed. The cylindrical fuel element is about 8 mm in diameter and about 12 mm in length.

C. Assembly of the Article

A seal is provided behind the fuel element (i.e., adjacent the fuel element toward the mouthend of the fuel element) by a coating of a high temperature silicone rubber sealant. The silicone rubber is commercially available as RTV Silicone Rubber Adhesive Sealant, RTV 106 High Temperature by General Electric, Waterford, NY. The seal forms a ring having a longitudinally extending thickness of about 1 mm around the cartridge and along the back face of the fuel element.

A tube shaped member is inserted around the capsule and abutting the seal. The tube has an outer diameter of 8 mm and an inner diameter sufficient to allow a snug fit against the cartridge. The tube is 25 mm in length. The tube is manufactured from a sheet of Owens Corning Glass (No. 6437) glass fibers formed into a tube and wrapped in circumscribing outer member in the form of P 850-192-2 paper from Kimberly-Clark. The glass fibers provide for a spaced apart relationship of the aerosol delivery means and the outer member. The abutting, snug fit of the outer member against the sealant provides an essentially air impermeable seal or barrier such that air within the outer member is essentially precluded from coming into contact with the fuel element. In particular, a barrier essentially preventing contact of air within the outer member with the fuel element is provided by the closed end of the cartridge as well as the seal.

A mouthend piece is provided from a cardboard tube having a length of 30 mm, an outer diameter of 8 mm, and an inner diameter of 7 mm. The cardboard tube surrounds the metal aerosol delivery means and abuts the mouth end of the previously described outer member. The mouthend piece is attached to the remaining portion of the article by essentially air impermeable adhesive tape which circumscribes portions of both the outer member and the cardboard tube.

The region between the metal aerosol delivery means and the mouthend piece in the region from about 15 mm to about 5 mm from the extreme end of the aerosol delivery means is sealed using the previously described silicone rubber sealant.

A source of air for aerosol formation is provided on the peripheral region of the outer member about 20 mm from the mouth end of the outer member. The source of air is 4 circumferencial places holes through the outer paper wrap (the glass fiber sheet is air permeable). Each of the holes are circular and have a diameter of about 0.5 mm.

The article is smoked using equipment used for standard FTC smoking conditions testing, but taking 50 ml puffs of 2 seconds duration once every 30 seconds. The article so tested yields aerosol on 10 puffs, no detectable carbon monoxide, 37 mg wet total particulate matter, and 644 micrograms of nicotine.

EXAMPLE 2

A smoking article substantially as illustrated in FIG. 3 is manufactured according to the following procedure.

An aerosol delivery means is provided as follows. An aluminum tube having a length of 55 mm, an outer diameter of 4.5 mm and an inner diameter of 4.4 mm is provided. One end of the tube is crimped sealed by folding 5 mm of the end thereof back over the tube thereby forming a closed ended elongated cartridge having an open portion extending 45 mm therealong, and a sealed end extending 5 mm therealong.

The cartridge is filled with about 200 mg of aerosol forming material and substrate. The substrate is high surface area alumina as described in Example 1. The aerosol forming material includes the materials described in Example 1. The open end of the cartridge is crimped slightly in order to maintain the substrate within the cartridge.

A fuel source is provided as described in Example 1. The cylindrical fuel element is about 8 mm in diameter, about 10 mm in length, and is positioned such that the extreme closed end of cartridge extends to the extreme lighting end thereof.

A seal is provided adjacent the fuel element as described in Example 1.

A tube shaped insulating member is inserted around the cartridge and abutting the seal. The tube has an outer diameter of 8 mm and an inner diameter sufficient to allow a snug fit on the cartridge. The tube is 40 mm in length, and is manufactured from materials as described in Example 1.

A seal is provided using the previously described silicone rubber sealant is provided toward the mouthend of the tubular member. The seal forms a ring having a longitudinally extending thickness of about 1 mm around the cartridge and along the back face (i.e., mouth end face) of the tubular member. In this manner, the so called "first portion" is provided.

A mouthend piece is provided from a cellulose acetate tube having a length of 30 mm, an outer diameter of about 8 mm and an inner diameter of about 4.5 mm. The tube is sold commercially as SCS-1 by American Filtrona Corp. The cellulose acetate tube is circumscribed by an outer paper wrap. The wrap is sold as 646 by Ecusta Corporation. Into the cellulose acetate tube is inserted an inner polyimide tube of 30 length, 4.5 outer diameter, and 4.4 mm inner diameter. The inner tube is sold commercially as Kapton by E. I. duPont de Nemours.

A filter element of 10 mm length is positioned at extreme mouth end of rod. The filter element is low efficiency cellulose acetate filter tow material.

The mouthend piece is positioned in an abutting end-to-end relationship with the previously described first portion. In particular, the mouth end of the cartridge and the foremost end of the inner tube abut in order that aerosol generated in the elongated cartridge can travel through the inner tube and to the mouth of the user.

The first portion and mouthend piece are connected by essentially air impermeable adhesive tape which circumscribes portions of the outer regions of both the first portion and the mouthend piece.

A source of air for aerosol formation is provided on a peripheral region of the outer member. In one embodiment, 2 holes each having a diameter of about 0.8 mm are punched through the outer wrap and the cartridge about 10 mm from the extreme back end of the cartridge.

In another embodiment, 2 similar holes are punched through the outer wrap and the cartridge in the region about 5 mm behind the fuel element, rather than near the back end of the cartridge.

The articles are smoked under smoking conditions described in Example 1, and each yield aerosol on 10 puffs, and deliver about 1 mg carbon monoxide.

EXAMPLE 3

A smoking article is provided as described in Example 2. However, the embodiment includes a source of air for aerosol formation positioned on the outer member in the form of 5 holes. One hole having a diameter of 0.5 mm is punched through the outer wrap and the cartridge about 5 mm behind the fuel element. Four holes having a diameter of 0.8 mm are circumferentially spaced about 5 mm from the extreme back end of the capsule.

The article is smoked under smoking conditions described in Example 1. The article yields aerosol on 10 puffs, 33 mg WTPM, no detectable carbon monoxide, and 309 micrograms of nicotine.

EXAMPLE 4

A smoking article substantially as illustrated in FIG. 4 is manufactured according to the following procedure.

An aerosol delivery means is provided as follows. An aluminum cartridge is provided from an aluminum tube, as described in Example 2. A 120 mesh aluminum screen is rolled into a tube-like cylinder and inserted into the cartridge. The screen is cut in order that it extends to the back end (i.e., mouth end) of the capsule. The length of the screen is 50 mm and the width is 2 mm.

The cartridge is loaded with about 100 mg of an aerosol forming substance. The aerosol forming substance is a mixture of 50 percent spray dried flue cured tobacco extract having a nicotine content of 5.17 percent, and 50 percent glycerin. The mouth end of the cartridge is crimped slightly.

The remaining portions of the article are provided using materials and techniques as described in Example 2.

The resulting embodiments, when smoked under conditions described in Example 1, yield about 1 mg carbon monoxide delivery.

EXAMPLE 5

A smoking article substantially as illustrated in FIG. 5 is manufactured according to the following procedure.

An aerosol delivery means is provided as follows. An aluminum tube having a length of 15 mm, an outer diameter of 4.5 mm and an inner diameter of 4.4 mm is fashioned into a crown-like shape at one end by cutting 4 slots of 1 mm width and 6 mm length from one end of the tube. The tube so provided has 4 extending "fingers" and is filled with the carbon paste described in Example 1.

A closed-end aluminum elongated cartridge having a length of 30 mm, an outer diameter of 4.4 mm and an inner diameter of 4.3 is provided. The closed end at front face of the cartridge is flattened such that the front face is positioned perpendicularly to the longitudinal axis of the cartridge. The previously described tube is fit over the closed end of the cartridge in a 5 mm overlap in a friction fit from such that the fingers of the crown extend away from the cartridge. Such a configuration is generally shown in FIG. 5A.

A cylindrical fuel source having a length of 15 mm and a diameter of 8 mm is provided over the cartridge in the manner described in Example 1, such that the fingers of the crown-like tube extend to the foremost or lighting end thereof.

The cartridge is filled with about 340 mg of aerosol forming material and substrate. The substrate is high surface area alumina as described in Example 1. The aerosol forming material includes the materials described in Example 1. The open end or mouth end of the cartridge is crimped slightly in order to maintain the substrate therewithin.

A seal is provided behind the fuel element as described in Example 1.

A tube shaped outer member and insulation is inserted around the cartridge behind the seal and abutting the seal. The tube has an outer diameter of 8 mm and an inner diameter sufficient to allow a snug fit against the cartridge. The tube is 24 mm in length, and is manufactured from materials as described in Example 1.

A flexible cellulose acetate tube having a length of about 40 mm, an outer diameter of 1.4 mm, and an inner diameter of 0.5 mm is inserted into the cartridge to a distance about 3 mm from the closed end.

A mouthend piece is a cardboard tube 25 mm in length, 8 mm in outer diameter and 7 mm in inner diameter is positioned in an abutting end-to-end relationship with the outer member and taped thereto by a circumscribing air impermeable tape.

A perforation of 1.4 mm diameter is cut into the mouthend piece about 15 mm from the extreme mouthend of the article. The cellulose acetate tube is positioned so as to extend into the perforation. A sealant is applied between the perforation and the outer portion of the cellulose acetate tube.

The article is smoked under conditions described in Example 1, and yields aerosol on 10 puffs, about 30 mg WTPM, about 1 mg carbon monoxide, and about 1,000 micrograms of nicotine.

EXAMPLE 6

A smoking article substantially as illustrated in FIG. 5 is manufactured according to the procedure described in Example 5. However, a higher density carbonized material is placed into the tube having the crown-like shape, and a lower density carbonized material is provided over the cartridge. In such a way, an article is provided and includes a fuel element having two distinct regions, each having differing burn properties.

The higher density material is provided as follows. Hardwood pulp carbonized under nitrogen atmosphere at 550° C for 2 hours and cooled over a 2 hour period as the oven temperature declines. A thick paste is provided from 25 g of the carbonized wood pulp, 3.9 g sodium carboxymethyl cellulose, and water.

The lower density material is provided as follows. Kapok is carbonized under the previously described conditions. A thick paste is provided from 2.5 g of hardwood carbon, 16.5 g of the carbonized kapok, 5.9 g sodium carboxymethyl cellulose, 5.5 g zirconium, and water.

The article is smoked under smoking conditions described in Example 1, and yields 25.5 mg WTPM and less than 1 mg carbon monoxide.

EXAMPLE 7

A smoking article substantially as illustrated in Example 4 is manufactured according to the procedure described in Example 4. However, aluminum pellets are employed as the substrate.

Such pellets are manufactured by folding squares of aluminum foil (3 mm by 3 mm) in an accordian-like fashion. The substrate for the article weighs about 200 mg. The aerosol forming material is described in Example 1. About 200 mg of aerosol forming material is applied to the substrate and cured under vacuum.

The article is smoked under smoking conditions described in Example 1 and yield 27 mg WTPM and about 1 mg carbon monoxide.

EXAMPLE 8

A smoking article substantially as illustrated in FIG. 7 is manufactured according to the following procedure.

A. Aerosol Delivery Means Preparation

An aluminum tube having a length of 30 mm, an outer diameter of 2.0 mm and an inner diameter of 1.8 mm is provided. A second aluminum tube having a length of 35 mm, an outer diameter of 4.5 mm, and an inner diameter of 4.4 mm is fashioned into a cartridge by drawing the tube through a die in order to form a tri-lobed shape. One end of the second tube is crimped closed over a 5 mm distance along the length thereof. The 30 mm first tube is fitted with a polyimide tube of 34 mm length, 4.5 mm outer diameter, and 4.4 mm inner diameter. The polyimide tube is sold commercially as Kapton by E. I. duPont de Nemours. The 30 mm first tube is fitted at one end with the polyimide tube such that the polyimide tube is inserted over one end of the aluminum tube and both fitted snugly together by way of a friction fit. The polyimide tube extends a longitudinally extending distance of about 5 mm over the aluminum tube to accomplish the friction fit.

The substrate is a carbon filament yarn commercially available as Kynol Catalogue No. CFY-020Y-3 from American Kynol, Inc., New York, N.Y. The yarn is cut into a 60 mm length thereby providing about 80 mg of substrate. The yarn is inserted into the polyimide tube and is held in place by friction fit. The yarn extends within the tube a total of about 20 mm along the length thereof, and is spaced about 5 mm from the end of the aluminum tube and about 5 mm from the open end of the polyimide tube.

The aerosol forming substance is a mixture of 62 percent glycerin, 31 percent propylene glycol and 7 percent nicotine. About 100 mg of the aerosol forming substance is added to the previously described substrate.

The first tube is inserted into the open end of the aforementioned cartridge to a distance of about 25 mm. The tri-lobed arrangement of the cartridge acts to hold the first tube in place by a snug friction fit. The overall length of the metal housing so provided is about 70 mm.

B. Fuel Element Preparation

Hardwood pulp is carbonized under nitrogen atmosphere at 550° C. for 2 hours and cooled over a 2 hour period as the oven temperature declines. Separately, kapok is carbonized under the same conditions. A dry mixture of 90 parts kapok and 10 parts sodium carboxymethyl cellulose (sold commercially as Hercules 7 HF) is mixed at ambient temperature with enough water to make a thick paste having a moisture content of about 80 percent. The fuel source is provided by mixing 25 g of the carbonized hardwood pulp, 12.58 g of the carbonized kapok/sodium carboxymethyl cellulose dry mixture, 3.95 g of the previously described sodium carboxymethylcellulose, 2.8 g zirconium and enough water to provide a thick paste.

The mold used to prepare the carbon fuel segment includes of two identical metal blocks into which a groove is cut on one side in order that a cylindrical passage is formed when the two blocks are placed together. Each groove is lined with aluminum foil. The foil is used to prevent the sticking of the carbon paste to the metal mold.

The carbonaceous paste is coated in the molds. In one mold, the metal aerosol delivery means is centered within the paste. Ring spacers along the periphery of the tube hold the tube centered within the carbon paste. The crimped end of the capsule extends to one end of the mold. The two paste filled molds are then clamped together and the carbon paste is dried at about 100° C. for about 8 hours. When the mold is taken apart, the aluminum foil is removed. The cylindrical fuel element is about 8 mm in diameter and about 12 mm in length.

C. Assembly of Article

A seal is provided behind the fuel element by a coating of a high temperature silicone rubber sealant. The silicone rubber is commercially available as RTV Silicone Rubber Adhesive Sealant, RTV 106 High Temperature by General Electric, Waterford, N.Y. The seal forms a ring having a longitudinally extending thickness of about 1 mm around the cartridge and along the back face of the fuel element.

A tube shaped insulating member is inserted around the cartridge behind the seal and abutting the seal. The tube has an outer diameter of 8 mm and an inner diameter sufficient to allow a snug fit on the capsule. The tube is 25 mm in length. The tube is manufactured from a sheet of Owen Corning Glass (No. 6437) glass fibers formed into a tube and the circumference is wrapped by an outer member in the form of P 850-192-2 paper from Kimberly Clark. The abutting, snug fit of the outer member against the sealant provides an essentially air impermeable seal such that air within the outer member cannot come into contact with the fuel element.

A mouthend piece is provided from a cardboard tube having a length of 30 mm, an outer diameter of 8 mm, and an inner diameter of 7 mm. The cardboard tube surrounds the metal aerosol delivery means and abuts the back end of the previously described outer member. The mouthend piece is attached to the remaining portion of the smoking article by essentially air impermeable adhesive tape which surrounds portions of both the outer member and the cardboard tube.

The region between the polyimide tube and the mouthend piece, in the region from about 15 mm to about 5 mm from the extreme end of the aerosol delivery means, is sealed using the previously described silicone rubber sealant.

A source of air for aerosol formation is provided on the peripheral region of the outer member about 20 mm from the extreme back end of the insulation and outer member. The source of air is 4 circumferencially placed holes through the outer paper wrap (the glass fiber sheet is air permeable). Each of the holes are circular and have a diameter of about 0.5 mm.

The article is smoked under conditions described in Example 1 and yields 12 puffs, each puff delivering aerosol. The article so tested has delivered 1,563 micrograms nicotine and 28.25 mg WTPM.

What is claimed is:

1. A cigarette-type aerosol delivery article comprising:

(a) a carbonaceous, combustible fuel element having a length of less than about 30 mm prior to use;

(b) aerosol generating means physically separate from the fuel element and including at least one aerosol forming substance;

(c) barrier means physically separate from the fuel element, and positioned between the fuel element and the aerosol generating means for substantially precluding combustion gases from the fuel element from passing directly through the article; and (d) means for providing a source of air to the aerosol generating means through the periphery of the article.

2. The article of claim 1 further comprising a heat conductive housing in contact with the fuel element.

3. The article of claim 2 wherein the heat conductive housing includes (i) an outer member having a closed end in contact with the fuel element and an opening spaced from the fuel element to allow air to enter, and (ii) a heat conductive inner member at least partially within the outer member, being in contact therewith and having at least a portion spaced from the outer member to form at least one air passageway therebetween, the inner member forming at least one air passageway.

4. The article of claim 3 wherein at least a portion of the outer member is embedded in the fuel element.

5. The article of claim 3 wherein the aerosol forming substance is located within the inner member.

6. The article of claim 3 wherein the passageways between the outer and inner members of the heat conductive housing channel air toward the fuel element end of the article during draw and the passageway within the inner member channels air toward the mouthend of the article during draw.

7. The article of claim 2 further comprising passage means to direct air from the peripheral air source to a region adjacent the fuel element for heating the air and for directing the heated air to the aerosol forming substance.

8. The article of claim 2 wherein the heat conductive housing forms a portion of the barrier means.

9. The article of claim 2 wherein the aerosol forming substance is carried by a substrate contained within the heat conductive housing.

10. The article of claim 9 wherein the heat conductive housing is provided with at least one peripheral opening to permit the passage of air therein.

11. The article of claim 1 or 9 wherein the aerosol forming substance includes at least one polyhydric alcohol.

12. The article of claims 2, 8 or 9 wherein the end of the housing near the fuel element is closed to substantially preclude gas flow from the fuel element to within the housing.

13. The article of claim 9 wherein the substrate is heat stable.

14. The article of claim 9 wherein the substrate is a carbon fiber material.

15. The article of claim 1, 2 or 8 wherein the periphery of the article includes at least one opening therein for providing a source of air to the aerosol generating means, the opening being longitudinally spaced from the periphery of the the fuel element.

16. The article of claim 1, 2 or 8 wherein the fuel element includes an agent for modifying the burn characteristics thereof.

17. The article of claim 1, 2 or 8 wherein the fuel element has a length of less than about 15 mm prior to use.

18. The article of claim 2, 8 or 9 wherein the heat conductive housing is metallic.

19. The article of claim 1 or 2, further comprising passage means to direct air from the peripheral air source to a region adjacent the fuel element for heating the air and for directing the heated air to the aerosol forming substance.

20. The article of claim 19 wherein the heat conducting member forms a portion of the passage means.

21. The article of claim 1, 2, 8 or 9 wherein the aerosol forming substance comprises at least one flavorant.

22. A cigarette-type aerosol delivery article comprising:

(a) heat source;

(b) aerosol generating means (i) physically separate from the heat source, (ii) in a heat exchange relationship with the heat source, and (iii) including at least one aerosol forming substance;

(c) means for providing a source of air to the aerosol generating means through the periphery of the article; and (d) barrier means physically separate from the heat source and positioned between the heat source and the aerosol generating means to substantially preclude gases introduced through the periphery of the article from contacting the heat source.

23. The article of claim 22 wherein the aerosol forming substance is carried by a substrate contained within the heat conductive housing.

24. The article of claim 22 wherein the periphery of the article includes at least one opening therein for providing a source of air to the aerosol generating means, the opening being longitudinally spaced from the periphery of the the fuel element.

25. The article of claim 22 wherein the aerosol forming substance includes at least one polyhydric alcohol.

26. The article of claim 22 wherein the aerosol forming substance comprises at least one flavorant.

27. The article of claim 22, further comprising passage means to direct air from the peripheral air source to a region adjacent the heat source for heating the air and for directing the heated air to the aerosol forming substance.

28. The article of claim 27 wherein the heat conducting member forms a portion of the passage means.

29. A cigarette-type aerosol delivery article comprising:

(a) a carbonaceous fuel element;

(b) a heat conductive housing in contact with the fuel element;

(c) aerosol generating means physically separate from the fuel element and including at least one aerosol forming substance;

(d) means for providing a source of air to the aerosol generating means through the periphery of the article; and (e) barrier means physically separate from the fuel element and positioned between the fuel element and the aerosol generating means to substantially preclude gases introduced through the periphery of the article from contacting the fuel element.

30. The article of claim 29 wherein the heat conductive housing forms a portion of the barrier means.

31. The article of claim 29 wherein the fuel element includes an agent for modifying the burn characteristics thereof.

32. The article of claim 29 wherein the heat conductive housing is metallic.

33. The article of claim 29 wherein the heat conductive housing includes (i) an outer member having a closed end in contact with the fuel element and an opening spaced from the fuel element to allow air to enter, and (ii) a heat conductive inner member at least partially within the outer member, being in contact therewith and having at least a portion spaced from the outer member to form at least one air passageway therebetween, the inner member forming at least one air passageway.

34. The article of claim 33 wherein at least a portion of the outer member is embedded in the fuel element.

35. The article of claim 29 or 30 wherein the periphery of the article includes at least one opening therein for providing a source of air to the aerosol generating means, the opening being longitudinally spaced from the periphery of the fuel element.

36. The article of claim 29 further comprising passage means to direct air from the peripheral air source to a region adjacent the heat source for heating the air and for directing the heated air to the aerosol forming substance.

37. The article of claim 36 wherein the heat conducting member forms a portion of the passage means.

38. A cigarette-type aerosol delivery article comprising:

(a) heat source;

(b) heat conductive housing;

(c) aerosol generating means physically separate from the heat source, including at least one aerosol forming substance, and contained within the conductive housing;

(d) outer member surrounding at least a portion of the length of and positioned in a spaced apart relationship with respect to the conductive housing; and (e) means for providing air to the aerosol generating means through the periphery of the article.

39. The article of claim 38 wherein the aerosol forming substance is carried by a substrate contained within the heat conductive housing.

40. The article of claim 38 wherein the heat conductive housing is metallic.

41. The article of claim 38 wherein the aerosol forming substance comprises at least one flavorant.

42. The article of claim 38 wherein the aerosol forming substance includes at least one polyhydric alcohol.

43. A cigarette-type aerosol delivery article comprising:

(a) a combustible carbonaceous fuel element having a length of less than about 30 mm prior to use;

(b) heat conductive housing;

(c) aerosol generating means physically separate from the fuel element, including at least one aerosol forming substance, and contained within the conductive housing;

(d) outer member surrounding at least a portion of the length of and positioned in a spaced apart relationship with respect to the conductive housing; and (e) means for providing air to the aerosol generating means through the periphery of the article through the outer member.

44. The article of claim 43 wherein the heat source has a length of less than about 15 mm.

* * * * *

UNITED STATES PATENT AND TRADEMARK OFFICE

CERTIFICATE OF CORRECTION

PATENT NO. : 4,819,665

DATED : April 11, 1989

INVENTOR(S) : Roberts et al

It is certified that error appears in the above-identified patent and that said Letters Patent is hereby corrected as shown below:

Col. 1, line 21, delete "None of the" and insert --Rainer et al. Despite these--.

Col. 1, line 21, after "it is believed that" insert --none of the--.

Col. 3, line 1, after "Bolt et al," insert --except that Moses proposed a double density plug of--.

Col. 17, line 29, after "PC" delete ".".

Col. 22, line 30, after "aluminum" insert --tube is filled--.

Col. 23, line 14, delete "carboxymethyl cellulose" and insert --carboxymethylcellulose--.

Col. 23, line 68, delete "mouth end" and insert --mouthend--.

Col. 25, line 2, after "30" insert --mm--.

Col. 25, line 2, after "4.5" insert --mm--.

Signed and Sealed this

Twenty-first Day of August, 1990

*Attest:*

HARRY F. MANBECK, JR.

*Attesting Officer*

*Commissioner of Patents and Trademarks*